US006154605A

United States Patent [19]

Aonuma

[11] Patent Number: 6,154,605

[45] Date of Patent: Nov. 28, 2000

[54] CONTROL DEVICE FOR DIAPHRAGM PUMP

[75] Inventor: Saburo Aonuma, Tokyo, Japan

[73] Assignee: Sataco Co., Ltd., Tokyo, Japan

[21] Appl. No.: 09/359,133

[22] Filed: Jul. 23, 1999

[51] Int. Cl.[7] ..... H02P 7/29

[52] U.S. Cl. ..... 388/829; 388/831; 318/159; 318/436

[58] Field of Search ..... 318/159, 40, 436; 388/804, 811, 842, 847, 815, 831, 832, 829; 417/22, 43, 45

[56] References Cited

U.S. PATENT DOCUMENTS

| | | | |
|---|---|---|---|
| 3,808,481 | 4/1974 | Rippel | 318/139 |
| 3,855,520 | 12/1974 | Stich | 323/19 |
| 4,240,014 | 12/1980 | Muller | 318/328 |
| 4,255,722 | 3/1981 | Hochstrate | 331/113 R |
| 4,257,746 | 3/1981 | Wells | 417/43 |
| 4,384,825 | 5/1983 | Thomas et al. | 417/22 |
| 5,295,790 | 3/1994 | Bossart et al. | 417/43 |
| 5,757,223 | 5/1998 | Nevin | 327/536 |

*Primary Examiner*—David Martin
*Assistant Examiner*—Rita Leykin
*Attorney, Agent, or Firm*—Armstrong, Westerman, Hattori, McLeland & Naughton

[57] ABSTRACT

A control device for a DC motor driving a diaphragm pump including a pulse generating integral circuit and a variable voltage setting integral circuit. The variable voltage setting integral circuit sets a pulse-base voltage at a level such that the DC motor is not rotated when no pulse is applied, thereby a high voltage overshoot generated at the rising and the falling point of an electrical pulse is restricted. Discharge of the diaphragm pump is accurately regulated by means of modifying frequency, voltage, and duty ratio of the pulse.

5 Claims, 7 Drawing Sheets

CONTROL DEVICE FOR DIAPHRAGM PUMP

BACKGROUND OF THE INVENTION

1. Field of the Invention

The present invention relates to a device for controlling a DC motor driven diaphragm pump, and more particularly to a device for controlling discharge of a DC motor driven diaphragm pump, which is used as a metering injection pump.

2. Description of the Related Art

An electric motor driven diaphragm pump has been shown in the prior art. An electric motor used as driving device for a diaphragm pump is commonly a stepping motor or a DC motor (Direct Current motor). When a stepping motor is used, discharge of the pump is controlled by means of controlling a rotation speed of the stepping motor by modifying frequency or duty ratio of applied pulses to the stepping motor. Although discharge of the pump is accurately regulated by the stepping motor, as shown in FIG. 7 depending on the duty ratio of pulses, discharge of the pump is changed so much that it is not applicable to a diaphragm pump for small amount metering. Furthermore, a stepping motor and a pulse frequency modulating device or a pulse duty control device are expensive and the weight of these devices are heavy. In FIG. 7, the relationship between a rotation speed of a stepping motor and discharge of a diaphragm pump is illustrated in the case of setting a pulse width(PW1) at 40 ms, 100 ms and 200 ms.

In the case of using a DC motor for driving a diaphragm pump, direct current at a constant voltage is applied to the DC motor to be rotated at constant speed, thereby the diaphragm pump discharges continuously constant amount of fluid. A flow control valve is required to be provided in a line after the discharge port of the diaphragm pump for metering a amount of fluid. Moreover, when a DC motor runs continuously, temperature of the motor vises a large amount as shown on the curve A in FIG. 6. The curve A illustrates changing temperature of DC motor when runs at 3,600 rpm (applied 2V DC).

Another controlling device of a DC motor as a actuator a diaphragm pump is to regulate a rotating amount of the DC motor by application of pulses. When applying pulses, a DC motor rotates intermittently and pumping pressure of a diaphragm pump is controlled by varying applied pulse voltage and discharge per a pumping cycle is regulated by modulating duty ratio of applied pulses. In FIG. 6, the curve B shows temperature of a DC motor in this case, the temperature of the motor is not so high but an overshoot at rising and falling period of a pulse (as shown in FIG. 6B) is repeatedly impressed to the DC motor, generating a spark at the commutator of the motor and deposit carbon in a brush contact plain of a commutator. This results in a reduction of the service life of the DC motor.

SUMMARY OF THE INVENTION

In view of the foregoing, it is an object of this invention to provide a controlling device for a DC motor driven diaphragm pump, which can supply and control a predetermined small amount of fluid in a stable manner and which can prolong the service life of the DC motor while reducing the cost.

Another object of the present invention is to provide a controlling device for a DC motor driven diaphragm pump, which applies pulses and a bias voltage to the DC motor at such a level that said DC motor does not rotate as a result of overshoot when a pulse is applied. Discharge of a diaphragm pump is regulated by modifying a duty ratio or frequency of applied pulses.

The control device for a DC motor of this invention comprises a pulse generating integral circuit having an astable multivibrator and a variable voltage setting integral circuit which sets a pulse-base voltage at such a level that a DC motor is not rotated.

The above and further objects and novel features of the present invention will more fully appear from the following detailed description when the same is read in connection with the accompanying drawings. It is to be expressly understood only and is not intended as a definition of the limits of the invention.

DESCRIPTION OF THE PREFERRED EMBODIMENTS

The preferred embodiment of this invention will now be described in detail with reference to the accompanying drawings.

Figure 1:
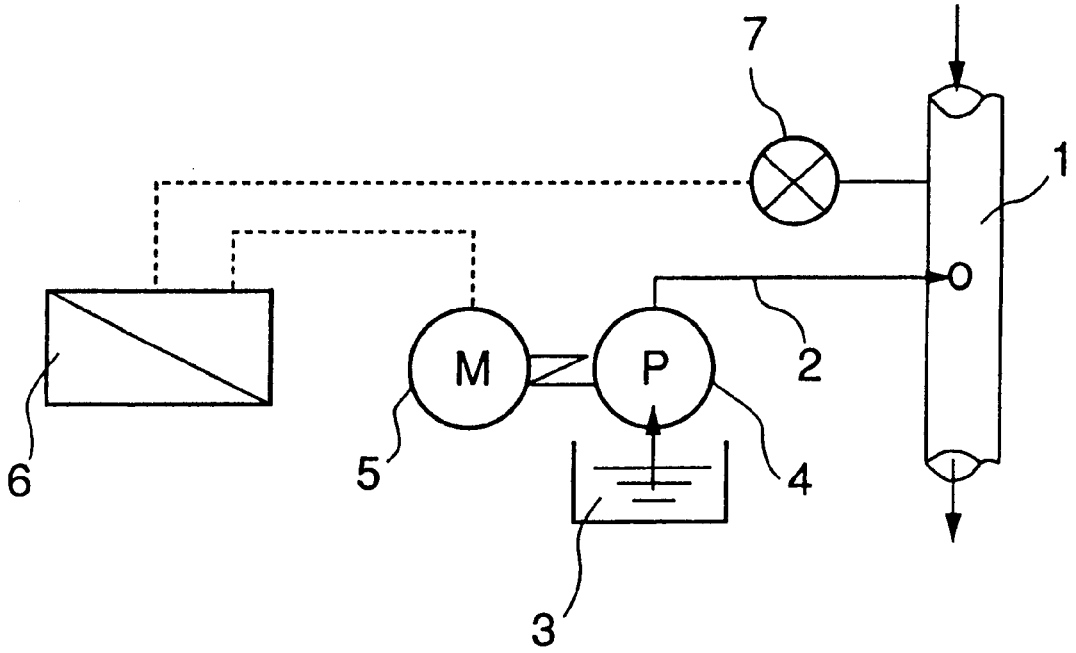
FIG. 1 diagrammatically illustrates an embodiment of a metering diaphragm pump controlling system of the present invention.

The diaphragm pump controlling system shown in FIG. 1 is used for a metering injection pump. The diaphragm pump 4 driven by DC motor 5 discharges liquid 3 from a tank into a fluid conduit 1 through an injecting pipe 2. The liquid 3, for example disinfectant, is mixed with flowing water in the conduit 1 at a predetermined constant rate. A control device 6 supplies pulses with DC motor 5 and modulates a duty ratio or frequency or voltage of the pulses to regulate discharge of the diaphragm pump 4. A flow sensor or pressure sensor 7 is provided in the conduit 1 for detecting a flow amount in the conduit 1 and detected signals are supplied to the control device 6.

Figure 2:
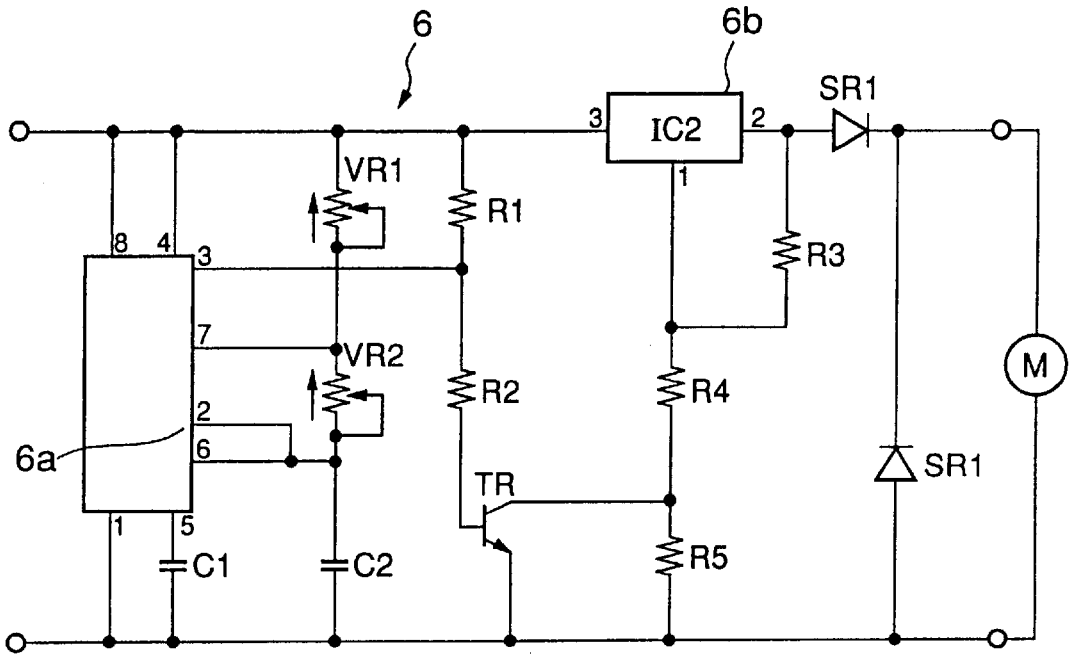
FIG. 2 is a schematic diagram of a circuit which may be employed by the device of FIG. 1.

A control device 6 includes a circuit as shown in FIG. 2. The circuit comprises a pulse generating integral circuit 6*a* having an astable multivibrator, a pulse-width modulator VR2, a frequency modulator VR1, an amplifier transistor TR and a variable voltage setting integral circuit 6*b* having a shutdown circuit. The voltage setting integral circuit 6*b* is used for setting a pulse-base voltage VCC2 and a pulse voltage VCC1 of a pulse from the pulse generating integral circuit 6*a*.

Figure 3:
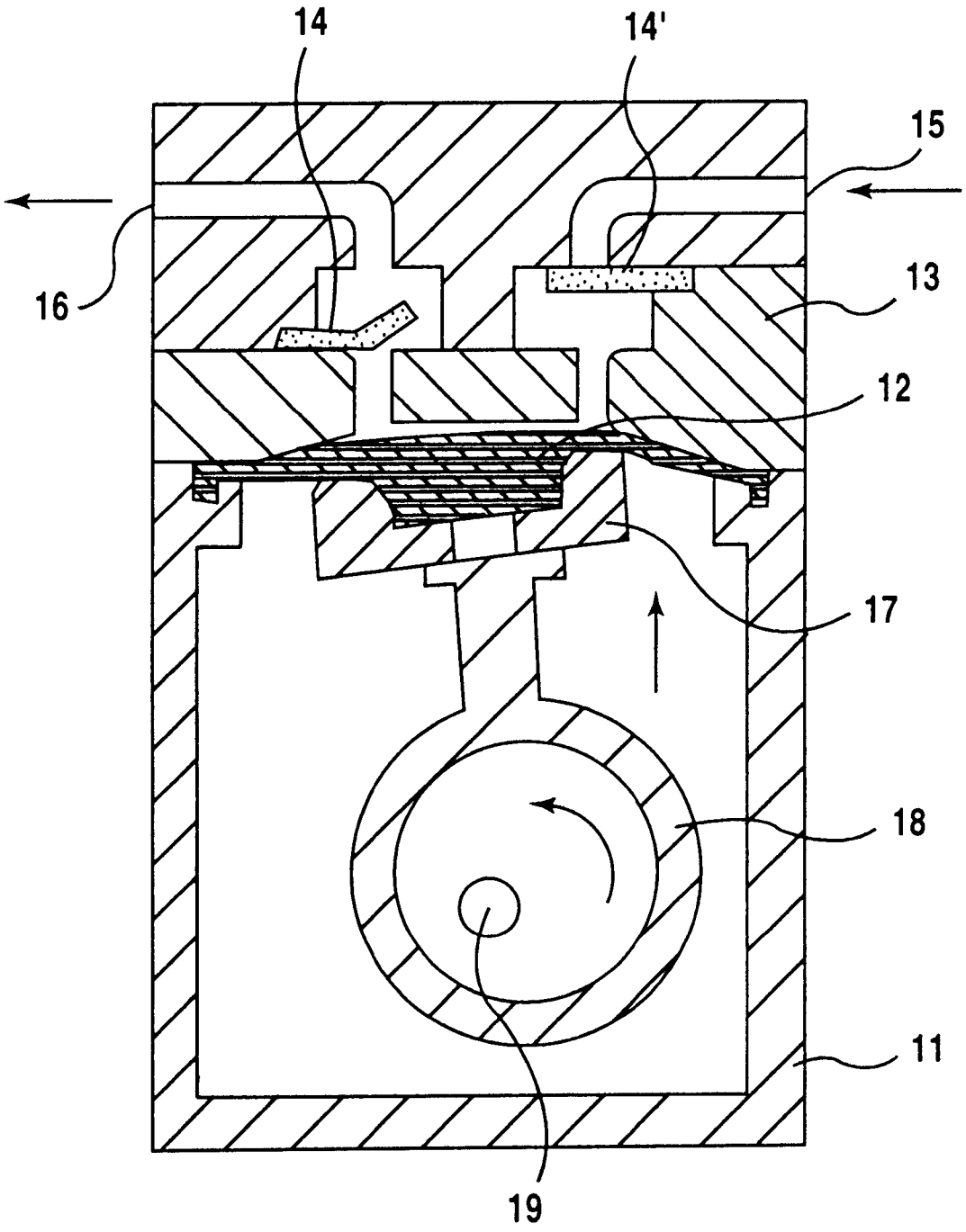
FIG. 3 is a schematic side elevation view of an example of a diaphragm pump.

A diaphragm pump as shown in FIG. 3 comprises a housing member 11, a diaphragm 12, a valve body 13 with valves 14, 14' mounted on, and a head member having a suction port 15 and discharge port 16. The diaphragm 12 is fixed to a holder 17 which is connected to a link rod 18. The link rod 18 has a ring portion in which a crankshaft 19 is rotatably supported.

Figure 4:
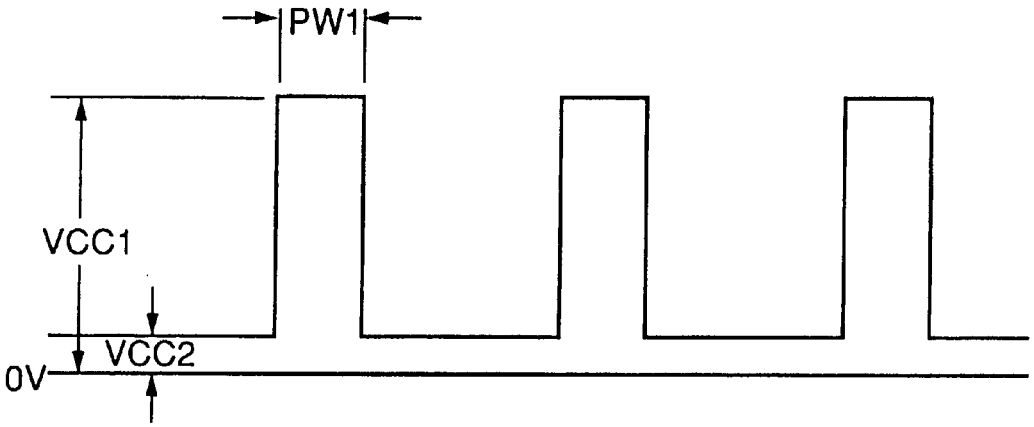
FIG. 4 is a wave form chart of pulse applying to a DC motor.

In operation of the diaphragm pump controlling system in FIG. 1, a desired discharge per pumping cycle and desired pumping pressure are regulated by setting a pulse duty ratio and a pulse voltage by means of a modulator VR2 and a voltage setting integral circuit 6*b,* furthermore, a desired discharge per minute is regulated by setting a frequency by means of a modulator VR1 and a bias voltage, as pulse-base voltage, is set by means of a voltage setting integral circuit 6*b*. The pulse-base voltage has a level such that the DC motor 5 is not rotated. Then, the control device 6 supplies the pulses to the DC motor 5, the DC motor 5 rotates and torque of the DC motor 5 is transmitted to the crankshaft. 19 of the diaphragm pump 4 to reciprocate the link rod and the diaphragm 12. The disinfectant 3 in the tank is suctioned from the suction port 15 and is discharged into the fluid conduit 1 through the discharge port 16 and the pipe 2. The disinfectant 3 is mixed with water flowing in the conduit 1 at a predetermined ratio. If desired, the detected signal of the flow sensor 7 is supplied to the control device 6, the control device modulates pulses (PW1,PW2,VCC1 as shown FIG. 4) automatically depending on the detected signal to regulate discharge of the diaphragm pump 4; thereby discharge of the disinfectant 3 is proportioned to flow amount of water in conduit 1.

By means of the control device 6 setting a pulse-base voltage, approximately 1.0 V in this embodiment, a bias voltage can applied to the DC motor 5, even when the DC motor 5 is not rotated. This make it possible to prevent a high voltage overshoot from having generated at a rising and falling period of a pulse and to reduce a rushing high current applied to the DC motor 5.

Figure 5:
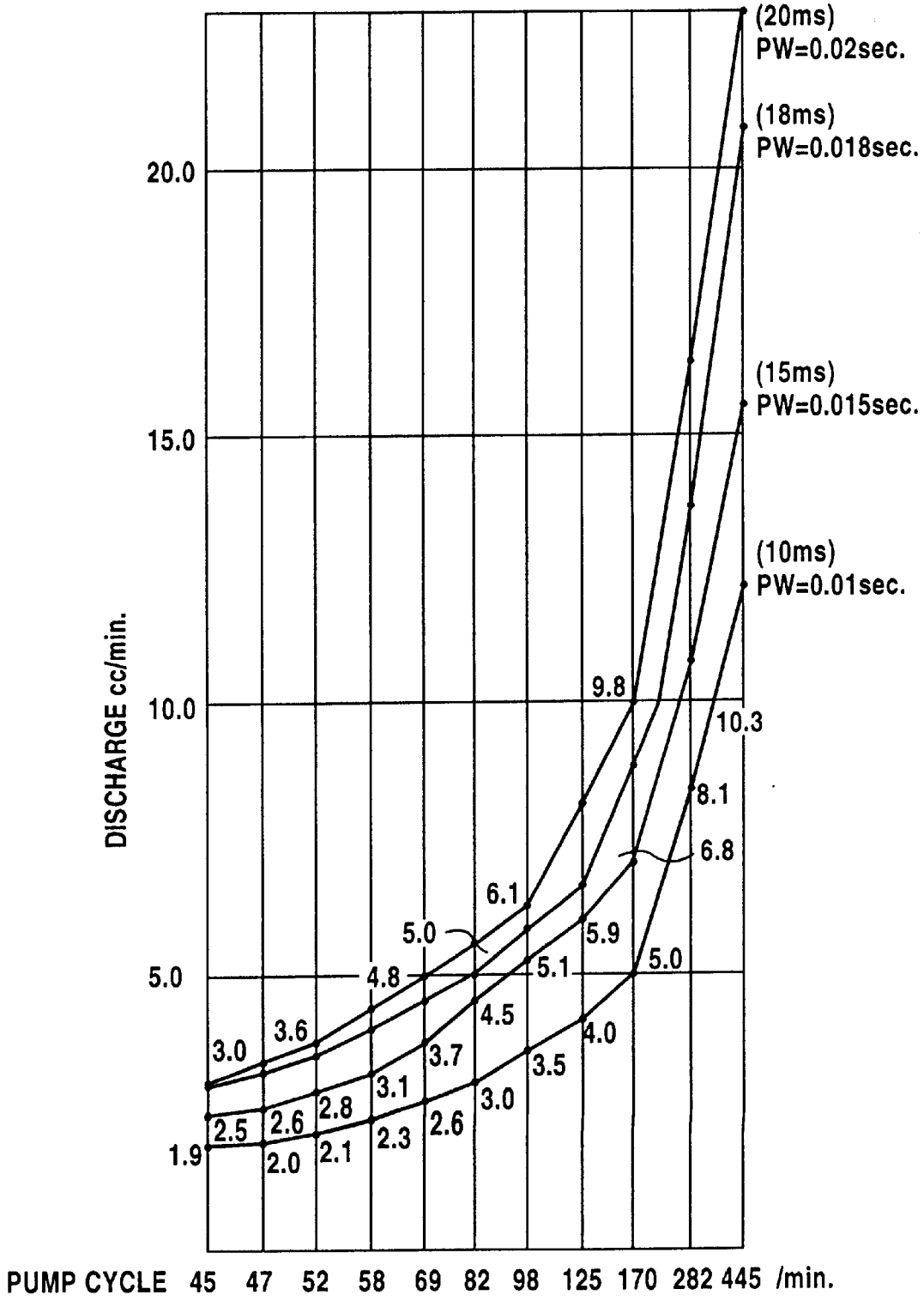
FIG. 5 is a graph showing the relations between discharge and applied pulse duty ratio of a DC motor driving a diaphragm pump in the experiment results of an embodiment of the invention.

FIG. 5 is a graph showing the relation between discharge and a pumping cycle in accordance to pulse-width in the experimental results of this embodiment. In FIG. 5, the vertical axis represents discharge of the diaphragm pump 4 and the horizontal axis represents a pumping cycle, each of four curves is in the case of DC motor 5 supplied of pulse-width at 10 ms (milli second),15 ms, 18 ms and 20 ms. It can be understood that discharge of the diaphragm pump 4 is increased at a substantially rate in proportion to pulse-width, in the range of from approximately 2.0 cc/min. to 20.0 cc/min.

The DC motor used in the experiment is an ordinary DC motor having a commutator, such the DC motor can be used for driving a metering diaphragm pump which continuously regulates discharge, when using the control device 6 of this invention.

Figure 6B:
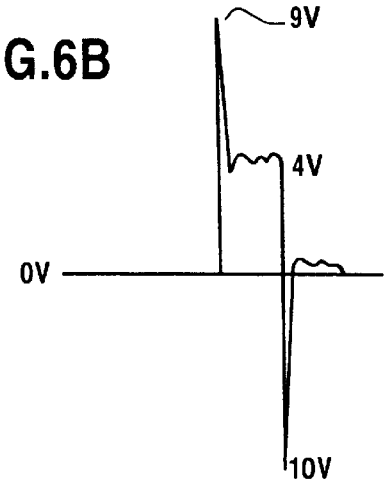
FIG. 6 is a graph showing the temperature—time relations for a DC motor of the invention and of prior arts.
Figure 6C:
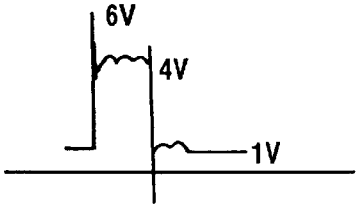
Figure 6A:
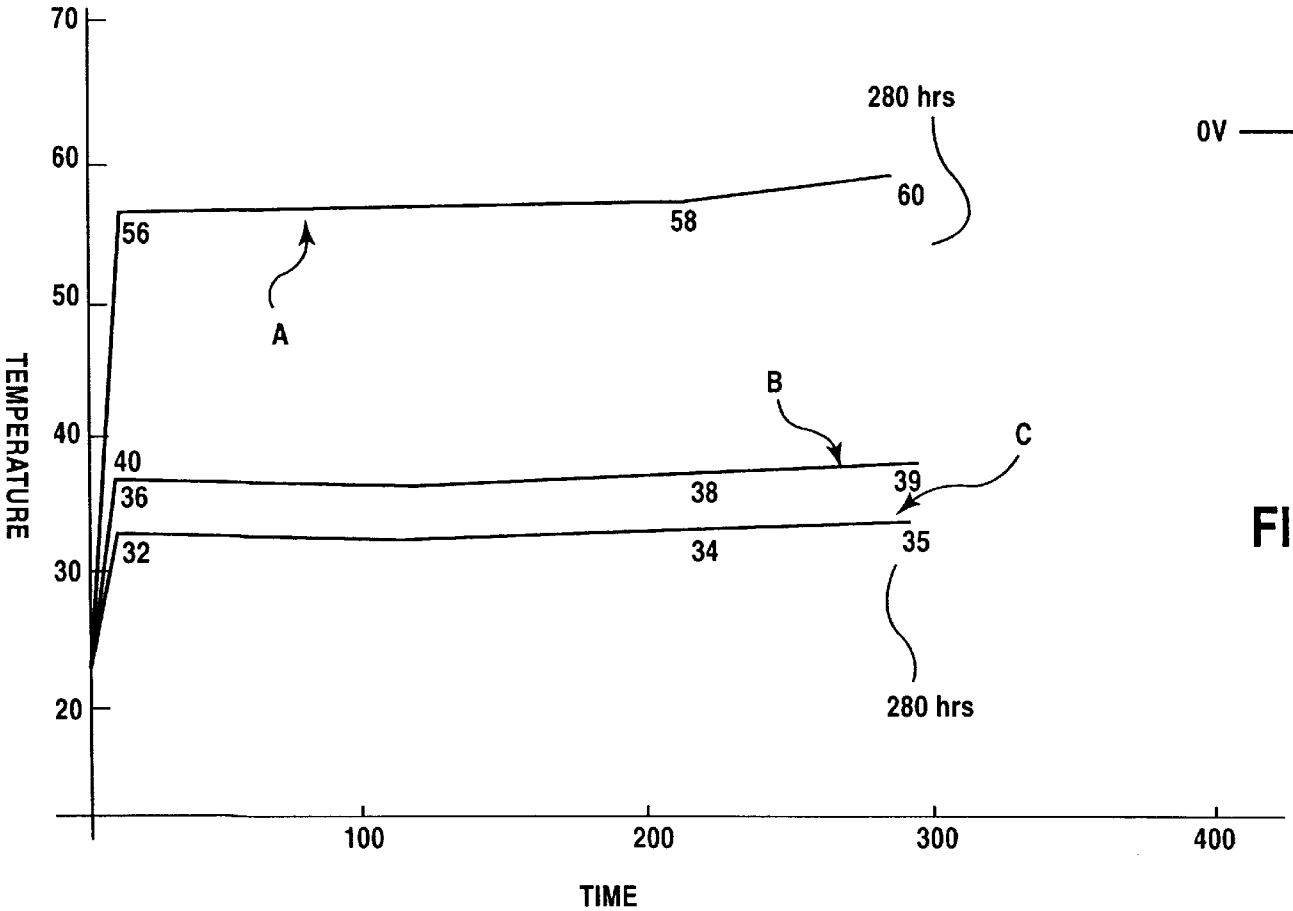
Figure 7:
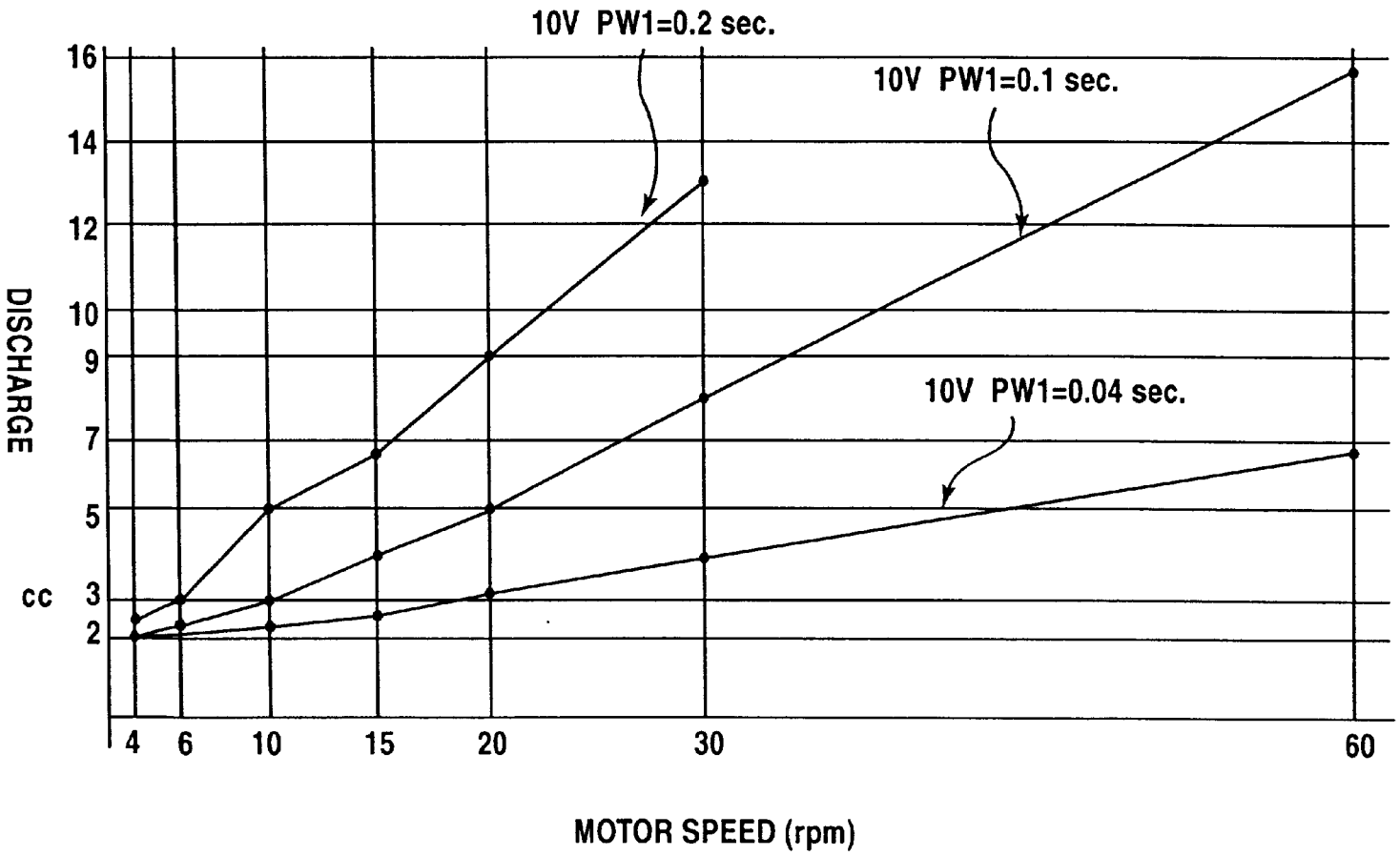
FIG. 7 is a graph showing the relations between discharge and applied pulse duty of a stepping motor driving a diaphragm pump.

FIG. 6 is a graph shown the relation between the temperature and running time of the DC motor 5. In FIG. 6, the curve represented by the symbol A is in the case of supplying direct current at a constant voltage of 2V to the DC motor, the curve represented by the symbol B is in the case of supplying pulses which are modulated a pulse voltage 4V (VCC 1) and pulse-base voltage 0V (VCC2, non bias voltage), the curve represented by the symbol C is in the case of this embodiment of this invention, supplying pulses of 4V(VCC1) and 1V (VCC2).

The curve A shows that the temperature of the DC motor rises up to 56° C. in a short running time at 3600 rpm. The curve B shows the temperature of the DC motor rises to 39° C. at a running time of 280 hrs, but pules waveform applied to the DC motor as shown in FIG. 6 B, a high voltage overshoot generated at pulse rising and falling points and a spark occurs at a brush contacting plane of a commutator to deposit carbon at the commutator. The curve C shows the temperature characteristics in the case of this invention where a bias voltage is applied to the DC motor at such a level that the DC motor is not rotated, an applied pulse waveform is shown in FIG. 6 C, an overshoot is restricted.

It is clear from these curves and the waveforms that the temperature of the DC motor of this invention is controlled to approximately half the temperature of the A type as known prior art, and a high voltage overshoot is restricted to approximately ⅔ that of the B type with no bias voltage applied.

As described above, it is evident that the controlling device for a diaphragm pump of the present invention provides an arrangement such that a discharge of a diaphragm pump is accurately regulated in stable manner, through the use of an ordinary DC motor with commutator and a simple controlling circuit which includes a pulse generating means and voltage setting means. Furthermore, according to the control device of the present invention, a high voltage overshoot generated when applying a pulse to a DC motor is restricted by means of a control circuit including a applying means a bias voltage to a DC motor so that a DC motor has a long service life.

While the invention has been described in detail and with reference to specific embodiment thereof, it will be apparent to one skilled in the art that various changes and modifications can be made therein without departing from the spirit and scope thereof.

What is claimed is:

1. A control device for a DC motor rotatingly driving a crankshaft of a diaphragm pump, the DC motor having a brush-type commutator, comprising:

a pulse generating circuit means for generating and supplying an electrical pulse to the DC motor;

a voltage setting circuit means connected to said pulse generating circuit means for setting a variable voltage of the electrical pulse and applying a bias voltage to the DC motor at a level such that the DC motor prevents rotation of the crankshaft of the diaphragm pump when no electrical pulse is applied.

2. A control device according to claim 1, wherein said voltage setting and circuit means sets a pulse-base voltage.

3. A control device according to claim 1, wherein said diaphragm pump has a discharge rate of less than 20 cc/min.

4. A control device according to claim 1, wherein said bias voltage is less than 2 V.

5. The control device recited in claim 1, wherein said pulse generating circuit means comprises a pulse generating integral circuit including an astable multivibrator, wherein said voltage setting circuit means includes a voltage setting integral circuit for setting the bias voltage applied to the DC motor, said control device further comprising:

an amplifying circuit connected between said pulse generating integral circuit and said voltage setting integral circuit.

* * * * *